US010479131B2

(12) United States Patent
Stevens

(10) Patent No.: US 10,479,131 B2
(45) Date of Patent: Nov. 19, 2019

(54) SEWING PATTERN ORGANIZER

(71) Applicant: Angie Stevens, Stow, OH (US)

(72) Inventor: Angie Stevens, Stow, OH (US)

( * ) Notice: Subject to any disclaimer, the term of this patent is extended or adjusted under 35 U.S.C. 154(b) by 13 days.

(21) Appl. No.: 15/895,647

(22) Filed: Feb. 13, 2018

(65) Prior Publication Data

US 2018/0229537 A1 Aug. 16, 2018

Related U.S. Application Data

(60) Provisional application No. 62/458,030, filed on Feb. 13, 2017.

(51) Int. Cl.

| | |
|---|---|
| ***B42F 7/14*** | (2006.01) |
| ***B42F 7/06*** | (2006.01) |
| ***B42F 21/06*** | (2006.01) |
| ***D05C 1/08*** | (2006.01) |

(52) U.S. Cl.

CPC ..... *B42F 7/14* (2013.01); *B42F 7/065* (2013.01); *B42F 7/145* (2013.01); *B42F 21/06* (2013.01); *D05C 1/08* (2013.01); *B42P 2241/02* (2013.01)

(58) Field of Classification Search

CPC .... B42F 7/06; B42F 7/065; B42F 7/14; B42F 21/06; B65D 85/00; D05C 1/08

USPC ..... 229/67.1–67.4; 383/40

See application file for complete search history.

(56) References Cited

U.S. PATENT DOCUMENTS

| | | | | |
|---|---|---|---|---|
| 3,692,170 | A * | 9/1972 | Woodward, Jr. ..... | A41H 31/00 206/450 |
| 4,058,215 | A * | 11/1977 | Marchbank ..... | B44C 5/02 206/574 |
| 4,889,232 | A * | 12/1989 | Asleson ..... | B65D 25/107 206/449 |
| 5,288,144 | A * | 2/1994 | Guderyon ..... | B42F 5/00 206/232 |
| 6,168,340 | B1 | 1/2001 | Lehmann | |
| 6,367,689 | B1 * | 4/2002 | Flynn ..... | B65D 27/34 229/67.1 |
| 6,905,064 | B1 * | 6/2005 | Ong ..... | B42F 7/08 229/67.1 |
| 7,147,104 | B2 * | 12/2006 | Ishii ..... | G11B 33/0438 206/425 |
| 7,165,687 | B1 | 1/2007 | Stevens | |
| 7,325,684 | B1 * | 2/2008 | Ramos ..... | B42F 15/026 206/425 |
| 2002/0121775 | A1 | 9/2002 | Sperry | |
| 2007/0114258 | A1 | 5/2007 | Miller | |
| 2009/0000975 | A1 * | 1/2009 | Schenker ..... | B42F 15/0094 206/425 |

* cited by examiner

*Primary Examiner* — Bryon P Gehman

(74) *Attorney, Agent, or Firm* — Integrity Patent Group, PLC; Charles Runyan

(57) ABSTRACT

An apparatus for storing and organizing sewing pattern pieces is disclosed herein. The apparatus may include a housing, a lid, locks, and a plurality of sleeves removably inserted within the housing. The apparatus may be useful for efficiently storing and organizing a plurality of pattern pieces to provide easy access to organized, unblemished pattern pieces.

2 Claims, 5 Drawing Sheets

SEWING PATTERN ORGANIZER

CROSS REFERENCE TO RELATED APPLICATION

The present application is related to and claims priority to U.S. Provisional Patent Application No. 62/458,030 filed Feb. 13, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of storage and organization and more specifically relates to an apparatus for storing and organizing sewing pattern pieces.

2. Description of Related Art

In sewing and fashion design, a pattern piece is the template from which the parts of a garment are traced onto fabric before being cut out and assembled. Patterns are usually made of paper, and are sometimes made of sturdier materials like paperboard or cardboard if they need to be more robust to withstand repeated use. Currently, storage and organization involves putting the pattern pieces back into the package they came in. This is cumbersome and time-consuming as the pattern pieces are typically difficult to put back into the package as neatly as they came out. Further, the package usually rips and the pattern pieces may become so wrinkled that they are unusable. Thus, a suitable solution is desired.

U.S. Pub. No. 2002/0121775 to Marietta Sperry relates to an expandable scrapbooking organizer. The described expandable scrapbooking organizer includes an organizer having one or more translucent or transparent wall(s), and one or more pocket(s) configured to conveniently hold 12"×12" sheets; and wherein the organizer can comprise additional pockets of different sizes, whereby at least some contents of the organizer can be visually discerned when the organizer is in a closed position.

BRIEF SUMMARY OF THE INVENTION

In view of the foregoing disadvantages inherent in the known storage and organization art, the present disclosure provides a novel sewing pattern organizer. The general purpose of the present disclosure, which will be described subsequently in greater detail, is to provide an apparatus configured to efficiently store and organize a plurality of pattern pieces to provide easy access to organized, unblemished pattern pieces.

An apparatus for storing and organizing sewing pattern pieces is disclosed herein. The apparatus for storing and organizing sewing pattern pieces includes a housing which may have an inner chamber defined by at least four side walls and a bottom surface. A lid may be removably attached to the housing and configured to cover the inner chamber of the housing, and a plurality of locking mechanisms may be coupled to the lid and configured to secure the lid to the housing. Further, a plurality of sleeves may be removably positioned inside the inner chamber of the housing, and each of the plurality of sleeves may be configured to house at least one piece of a sewing pattern.

A method of using apparatus for storing and organizing sewing pattern pieces is also disclosed herein. The method of using apparatus for storing and organizing sewing pattern pieces may comprise the steps of: providing the apparatus as above; inserting the at least one piece of the sewing pattern into at least one of the plurality of sleeves; positioning the at least one of the plurality of sleeves into the inner chamber of the housing; covering the inner chamber of the housing with the lid; and securing the lid onto the housing with at least one of the plurality of locking mechanisms.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a sewing pattern organizer, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a storage and organization apparatus and more particularly to a sewing pattern organizer as used to improve storing and organizing sewing pattern pieces.

Generally, disclosed is a case composed of a strong durable plastic comprising lightweight individual pockets therein. The case may be useful for the storage and organization of paper patterns used in sewing and allows for easy access of the patterns. The case may hold up to 60 complete patterns and instructions of each pattern. The case may allow easy access to pattern pieces without compromising style and design. As above, the case may be made from durable transparent plastic or other suitable material.

Additionally, the case may have a lid that connects to a base of the case via two latches located on each side of the case. The lid may include a variety of stylish designs to accommodate user preference. Further, the interior of the case may include approximately 15 sleeves with two pockets on each side—four pockets to hold instructions and individual pattern pieces. The sleeves may also be transparent to easily see what's inside. The pockets may further include a flap over both sides of the sleeves to cover the pocket opening. The flaps may include hook and loop fastening material. Above each pocket may be a blank, white label configured to be written on. Writing on the blank, white label may describe contents of the pockets.

Referring now more specifically to the drawings by numerals of reference, there is shown in FIGS. 1-4, various views of an apparatus for storing and organizing sewing pattern pieces ("apparatus" 100).

Figure 1:
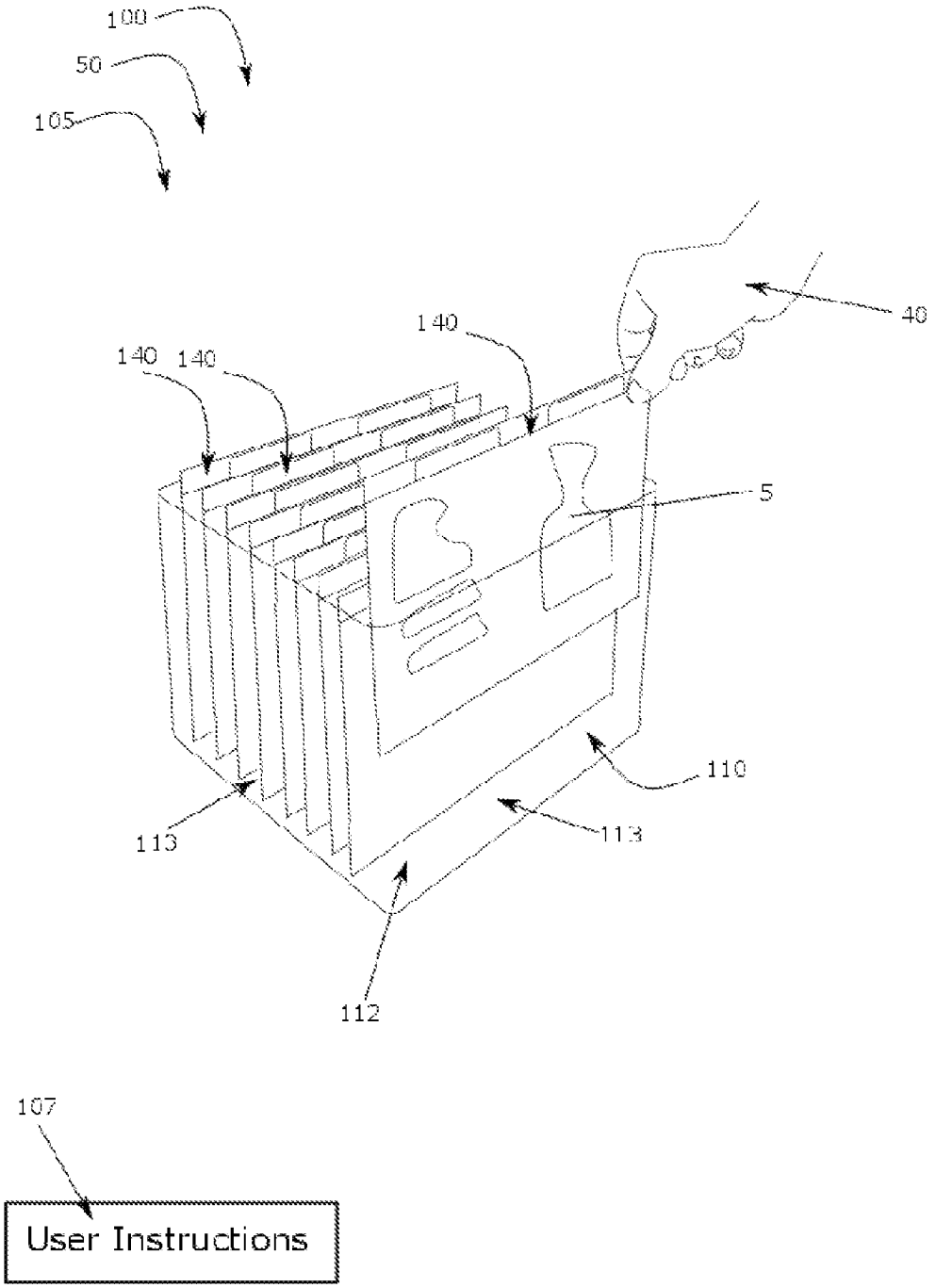
FIG. 1 is a perspective view of the apparatus for storing and organizing sewing pattern pieces during an 'in-use' condition, according to an embodiment of the disclosure.

FIG. 1 shows an apparatus 100 during an 'in-use' condition 150, according to an embodiment of the present disclosure. As illustrated, the apparatus 100 may include a housing 110, a lid 120, a plurality of locking mechanisms 130, and a plurality of sleeves 140. As shown, each of the plurality of sleeves 140 may be configured to house at least one piece 5 of a plurality of sewing pattern pieces.

According to one embodiment, the apparatus 100 may be arranged as a kit. The kit may include a set of instructions 107. The instructions may detail functional relationships in relation to the structure of the apparatus 100 (such that the apparatus 100 can be used, maintained, or the like, in a preferred manner).

Figure 2:
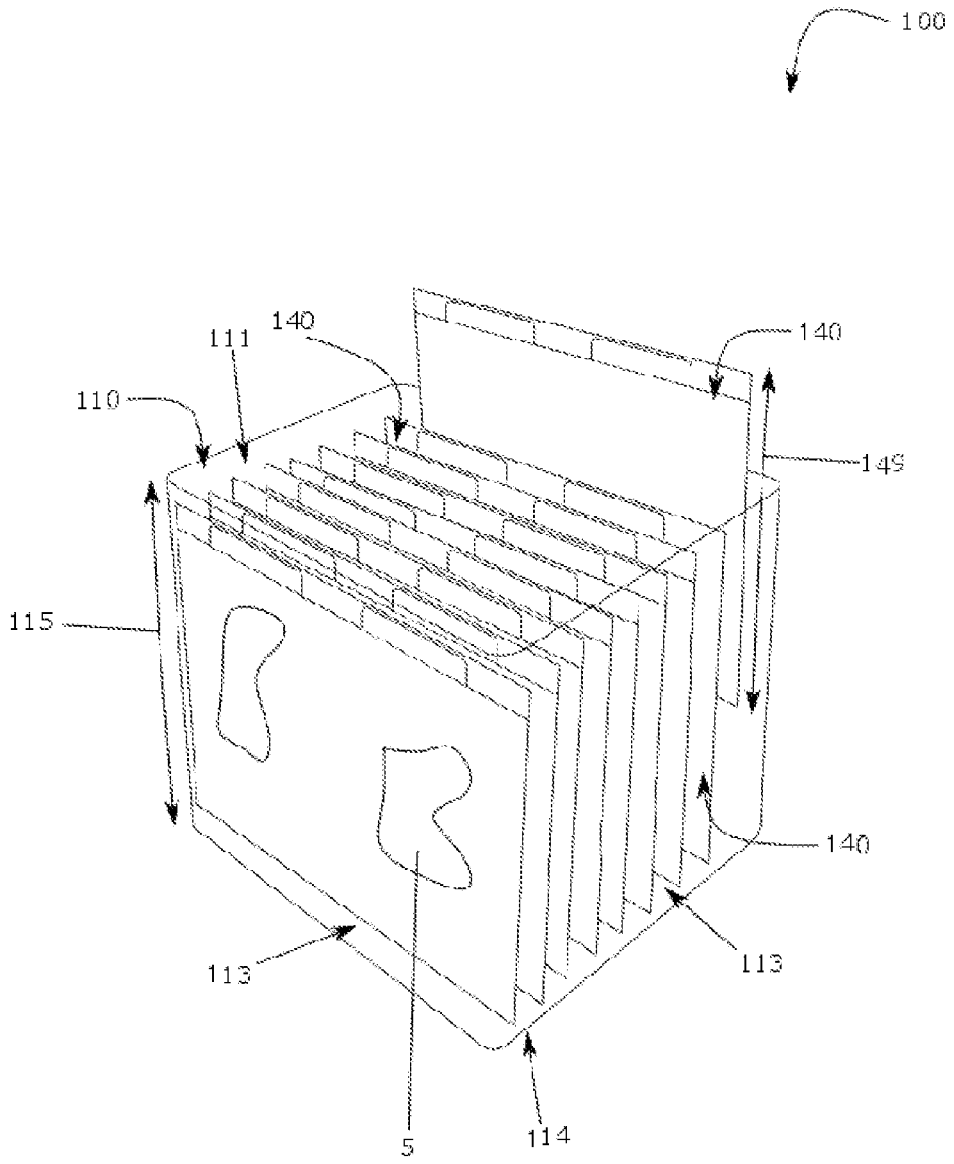
FIG. 2 is a perspective view of the apparatus for storing and organizing sewing pattern pieces of FIG. 1, according to an embodiment of the present disclosure.

FIG. 2 shows a perspective view of the apparatus 100 of FIG. 1, according to an embodiment of the present disclosure. Shown here is the plurality of sleeves 140 removably positioned inside the inner chamber 111. The housing 110 may include an inner chamber 111 defined by at least four side walls 113 and a bottom surface 114. In a preferred embodiment, the housing 110 may be made from a strong durable plastic. In other embodiments, the housing 110 may be made from a cardboard material, a fabric material, a metal material, etc.

As demonstrated here, the inner chamber 111 of the housing 110 may have a depth 115 greater than a height 149 of the plurality of sleeves 140. This may enable the plurality of sleeves 140 to fit securely within the inner chamber 111 of the housing 110.

The plurality of sleeves 140 may be removably positioned inside the inner chamber 111 of the housing 110, and as shown, each of the plurality of sleeves 140 may be configured to house the at least one piece 5 of the plurality of sewing pattern pieces. The plurality of sleeves 140 may be at least fifteen. In the preferred embodiment, the plurality of sleeves 140 may be made from a flexible plastic material, and further, the plurality of sleeves 140 may be made from a transparent material. In this embodiment, the pattern pieces 5 may be viewed from an exterior of the plurality of sleeves 140 to prevent a user 40 from having to open one of the plurality of sleeves 140 to view its contents.

Figure 3:
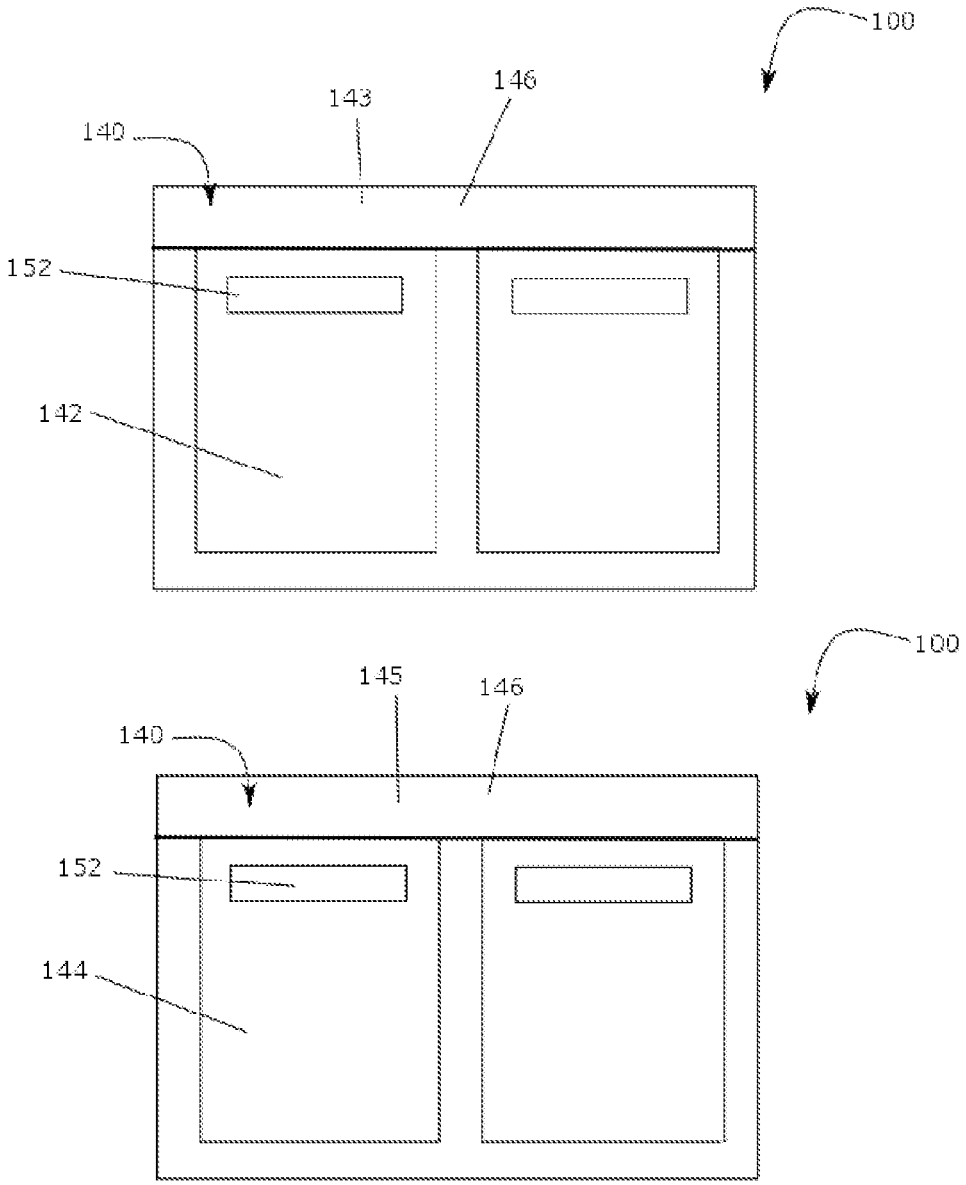
FIG. 3 is a front view of the apparatus for storing and organizing sewing pattern pieces of FIG. 1, according to an embodiment of the present disclosure.

FIG. 3 shows a front view and a rear view of the apparatus 100 of FIG. 1, according to an embodiment of the present disclosure. Demonstrated in this figure is one of the plurality of sleeves 140 including a plurality of elements. For example, each of the plurality of sleeves 140 may have at least one front-pocket 142 on a front side 143 of the sleeve, and similarly, each of the plurality of sleeves 140 may have at least one back-pocket 144 on a back side 145 of the sleeve.

Further, at least one flap 146 may be coupled to the front side 143 of the sleeve and configured to cover an opening of the at least one front-pocket 142. Similarly, at least one flap 146 may be coupled to the back side 145 of the sleeve and configured to cover an opening of the at least one back-pocket 144. As demonstrated, the at least one flap 146 may be configured to cover the opening of the at least one front-pocket 142 on the front side 143 of the sleeve by a fastening means, and the at least one flap 146 may be configured to cover the opening of the at least one back-pocket 144 on the back side 145 of the sleeve by the fastening means. In a preferred embodiment, the fastening means may be a hook and loop fastener.

An identification means 152 may be removably located above the at least one front-pocket 142 of the front side 143 of the sleeve, and similarly, the identification means 152 may be removably located above the at least one back-pocket 144 of the back side 145 of the sleeve. In the preferred embodiment, the identification means 152 may be a label. The label may be blank and may be written on by the user 40. In one example, the user 40 may write on the label located on one of the front-pocket 142 or the back-pocket 144 to identify which pattern piece is located therein.

Figure 4:
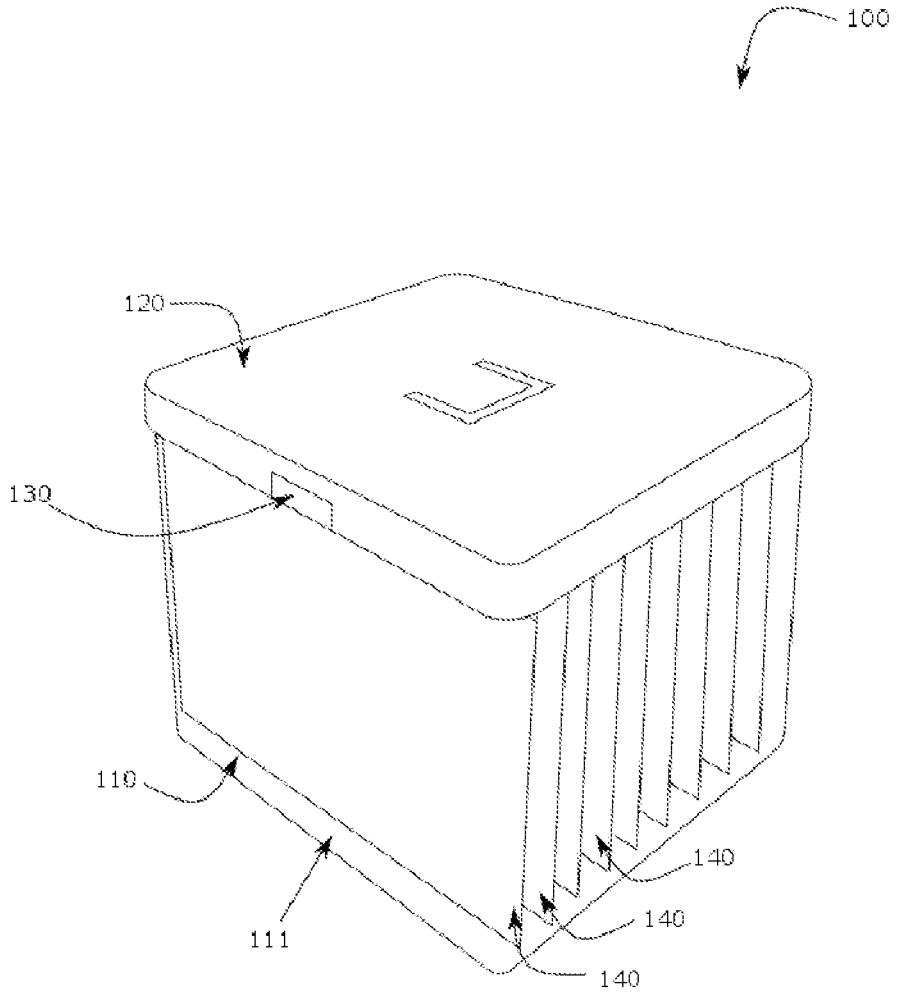
FIG. 4 is a perspective view of the apparatus for storing and organizing sewing pattern pieces of FIG. 1, according to an embodiment of the present disclosure.

Referring now to FIG. 4 showing a perspective view of the apparatus 100 of FIG. 1, according to an embodiment of the present disclosure. Shown here is the housing 110 including the lid 120. As shown, the lid 120 may be removably attached to the housing 110 and configured to cover the inner chamber 111 of the housing 110. The lid 120 may include a variety of designs. In addition, the lid 120 may be manufactured in a variety of materials.

Further, as shown, the plurality of locking mechanisms 130 may be coupled to the lid 120 and configured to secure the lid 120 to the housing 110. The plurality of locking mechanisms 130 may be two latches located on opposite sides of the lid 120. However, it should be appreciated that other locking mechanisms may be used.

Figure 5:
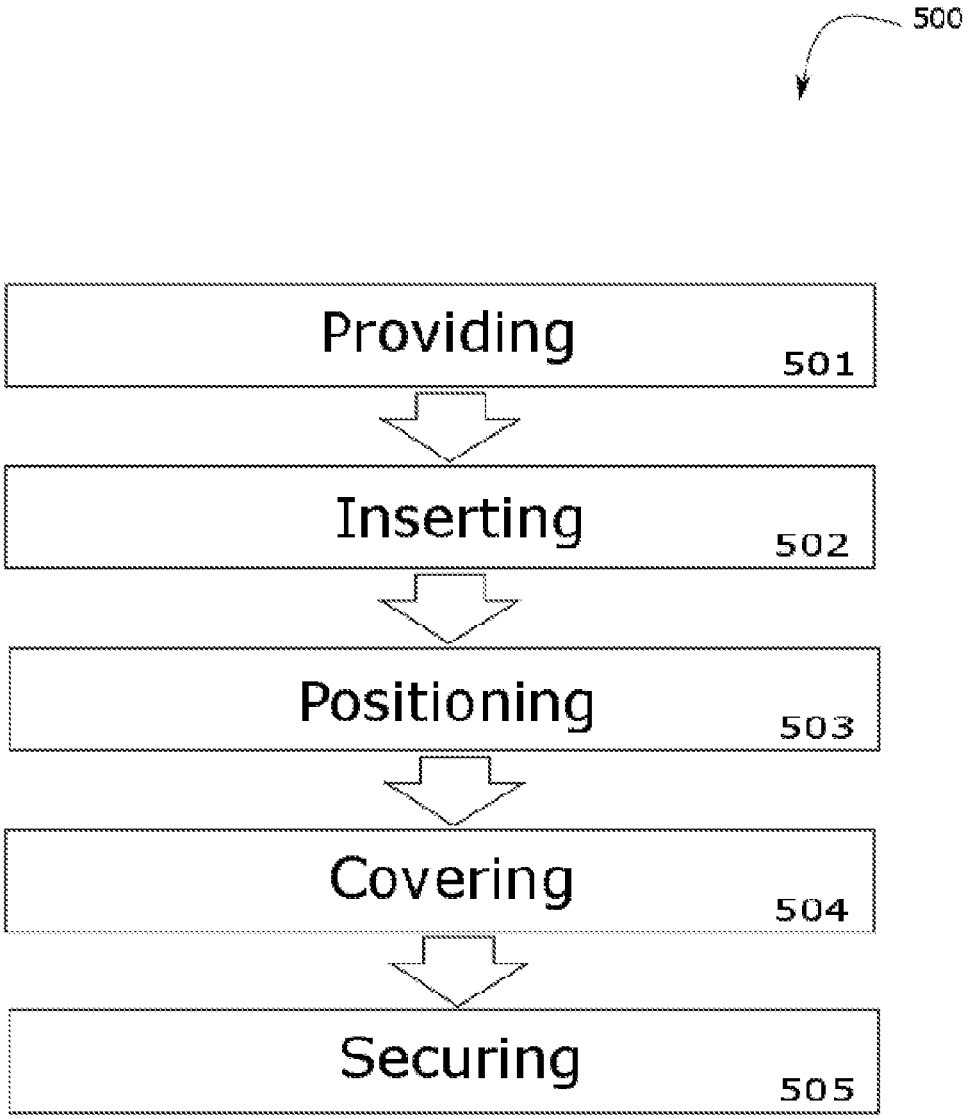
FIG. 5 is a flow diagram illustrating a method of use for the apparatus for storing and organizing sewing pattern pieces, according to an embodiment of the present disclosure.

FIG. 5 is a flow diagram illustrating a method for using an apparatus for storing and organizing sewing pattern pieces 500, according to an embodiment of the present disclosure. As illustrated, the method for using an apparatus for storing and organizing sewing pattern pieces 500 may include the steps of: step one 501, providing the apparatus 100 as above; step two 502, inserting the at least one piece of the sewing pattern 5 into at least one of the plurality of sleeves 140; step three 503, positioning the at least one of the plurality of sleeves 140 into the inner chamber 111 of the housing 110; step four 504, covering the inner chamber 111 of the housing 110 with the lid 120; and step five 505, securing the lid 120 onto the housing 110 with at least one of the plurality of locking mechanisms 130.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for apparatus 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An apparatus for storing and organizing sewing pattern pieces, the apparatus for storing and organizing sewing pattern pieces comprising:

a housing having an inner chamber defined by at least four side walls and a bottom surface;

a lid, said lid removably attached to said housing and configured to cover said inner chamber of said housing;

a plurality of locking mechanisms, said plurality of locking mechanisms being coupled to said lid and configured to secure said lid to said housing; and a plurality of sleeves, said plurality of sleeves removably positioned inside said inner chamber of said housing, and wherein each of said plurality of sleeves is configured to contain a sewing pattern piece; and wherein each of said plurality of sleeves has at least one front-pocket on a front side of said sleeve;

wherein each of said plurality of sleeves has at least one back-pocket on a back side of said sleeve;

wherein said plurality of sleeves is at least fifteen said sleeves;

wherein said plurality of sleeves is made from a transparent material;

wherein the apparatus further comprises at least one flap coupled to said front side of said sleeve and configured to cover an opening of said at least one front-pocket;

wherein the apparatus further comprises at least one flap coupled to said back side of said sleeve and configured to cover an opening of said at least one back-pocket;

wherein said at least one flap is configured to cover said opening of said at least one front-pocket on said front side of said sleeve by a means for fastening said at least one flap;

wherein said at least one flap is configured to cover said opening of said at least one back-pocket on said back side of said sleeve by the fastening means;

wherein said fastening means is a hook and loop fastener;

wherein the apparatus further comprises a means for labeling the sewing pattern pieces removably located above said at least one front-pocket of said front side of said sleeve;

wherein said identification means is a label;

wherein said apparatus is made from a strong durable plastic;

wherein said inner chamber of said housing has a depth greater than a height of a sleeve of said plurality of sleeves;

wherein said plurality of sleeves is made from a flexible plastic material; and wherein said plurality of locking mechanisms is two latches located on opposite sides of said lid.

2. A method for using an apparatus for storing and organizing sewing pattern pieces, the method comprising the steps of:

providing the apparatus for storing and organizing sewing pattern pieces of claim 1 inserting the at least one sewing pattern piece into at least one of the plurality of sleeves;

positioning the at least one of the plurality of sleeves into the inner chamber of the housing;

covering the inner chamber of the housing with the lid; and securing the lid onto the housing with at least one of the plurality of locking mechanisms.

* * * * *